United States Patent [19]

Goddard

[11] Patent Number: 4,892,353

[45] Date of Patent: Jan. 9, 1990

[54] COVER FOR LOUNGE CHAIR

[76] Inventor: Dan J. Goddard, 5407 W. Roanoke Ave., Phoenix, Ariz. 85035

[21] Appl. No.: 319,329

[22] Filed: Mar. 6, 1989

[51] Int. Cl.[4] ..... A47C 31/00

[52] U.S. Cl. ..... 297/224; 297/183; 297/229

[58] Field of Search ..... 297/218, 219, 224, 229; 5/446, 486, 496, 497, 499

[56] References Cited

U.S. PATENT DOCUMENTS

| | | | |
|---|---|---|---|
| 1,820,104 | 8/1931 | Whaley | 297/224 |
| 1,889,662 | 11/1932 | Hyman | 297/229 X |
| 1,970,820 | 8/1934 | Schoelkopf | 297/224 |
| 4,518,198 | 5/1985 | Daniels | 297/229 |
| 4,536,028 | 8/1985 | Jones et al. | 297/224 |
| 4,553,785 | 11/1985 | Duke, Jr. et al. | 297/229 |
| 4,669,779 | 6/1987 | Kaganoes et al. | 297/224 X |

*Primary Examiner*—Peter R. Brown

*Attorney, Agent, or Firm*—Gregory J. Nelson

[57] ABSTRACT

A cover for a chaise lounge chair having a body section of absorbent material extending over the chair surface. Fitted pockets engage the head and foot ends of the lounge. Drop pockets are provided at the side of the cover and hang generally vertically when the cover is in place. An intermediate elasticized section extends transversely of the cover with elastic bands extending adjacent the elasticized strip.

7 Claims, 2 Drawing Sheets

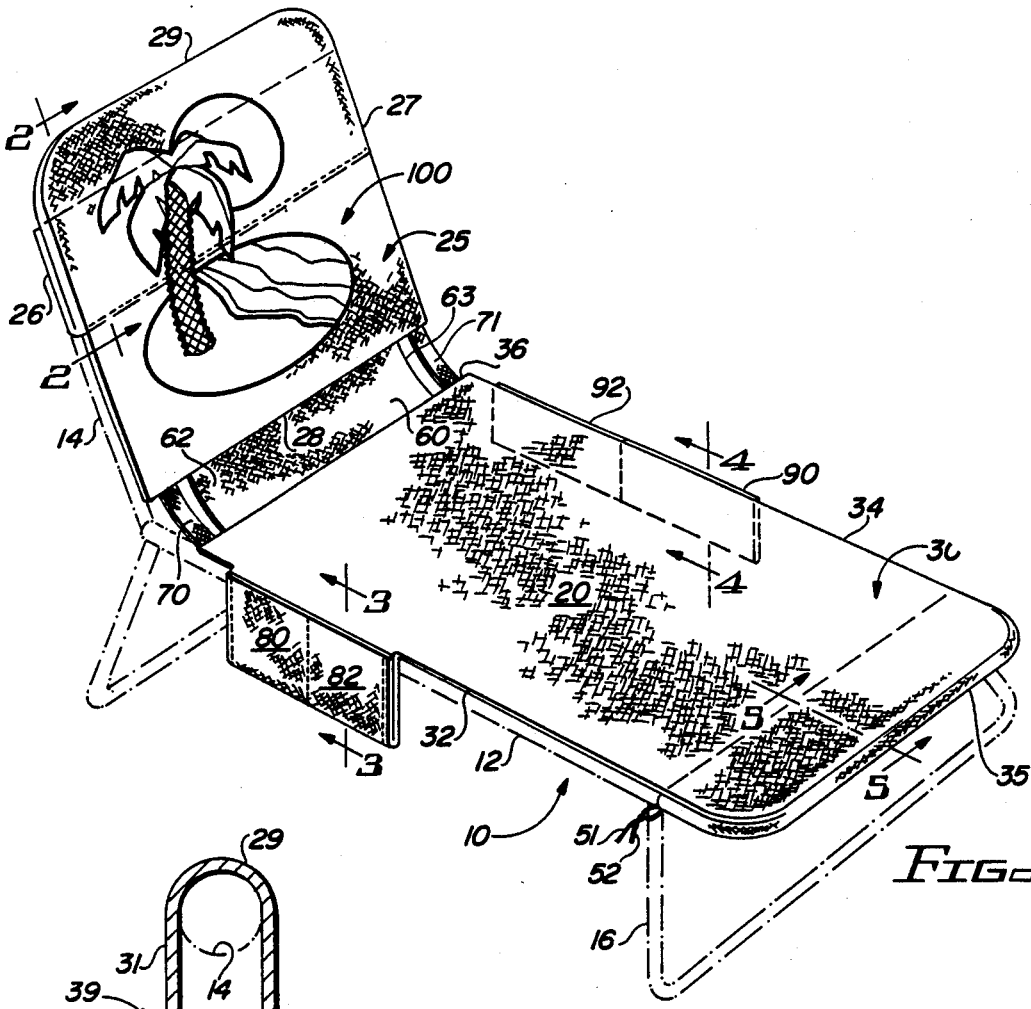
FIG. 1
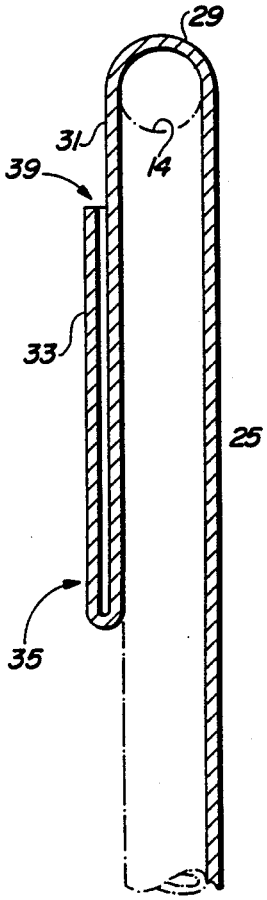
FIG. 2
FIG. 3
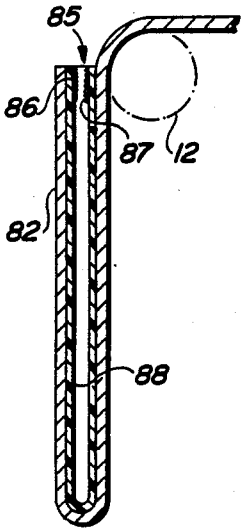
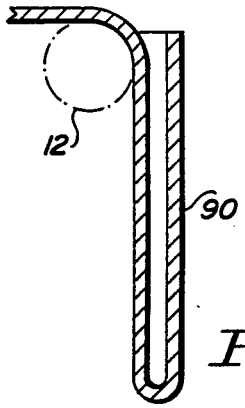
FIG. 4
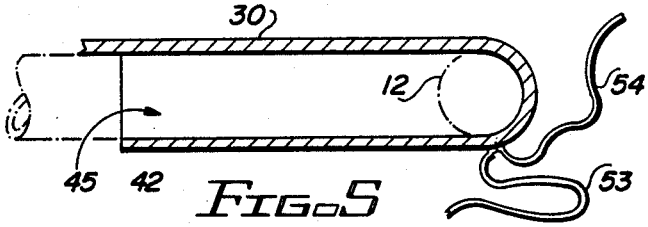
FIG. 5

COVER FOR LOUNGE CHAIR

FIELD OF INVENTION

The present invention relates to a fitted cover and more particularly to a fitted cover for use with chaise lounge chairs of the type commonly used at poolside or outdoors.

Outdoor recreational chairs such as lawn chairs or poolside chairs generally have a frame which supports some type of mattress or pad such as an air mattress or a pad filled with a soft filler material. Such pads have an outer covering of canvas or synthetic material such as that sold under the trademark Textiline which covering may become soiled or after exposure to the sun may become hot. Accordingly, it is common practice for sun bathers and those using such chairs to drape a beach or pool towel or blanket over the mattress or chaise pad for the comfort and convenience of the user. The towel absorbs suntan and body oils and also protects the user from the hot surface of the pad. The disadvantage of using a towel as covering is that the towel is not secured to the chair and accordingly the towel or blanket is subject to shifting either due to the wind or movement of the user. Accordingly, the user must continually readjust or reposition the towel to make certain that the towel or blanket covers the surface beneath the user.

In order to provide a more effective temporary covering for casual furniture, the prior art suggests several fitted covers for lounge or chaise-type recreational chairs. For example, U.S. Pat. No. 4,536,028 shows a fitted sheet particularly adapted for use with lounge chairs having a top panel with pockets formed at the end of the panel which fit over the ends of the chair and which are further provided with elastic straps where the head and foot portion of the chair are hingedly connected to the horizontal central section of the chair. A gathering of material in the central portion of the covering provides enhanced versatility and increased conformity of the sheet to the chair.

U.S. Pat. No. 4,671,568 discloses a terry cloth mattress and lawn chair towel cover with a continuous elastic border. A peripheral hem is inserted into an elastic band to cause snug fitting of the towel to an air mattress or mattress of the lawn chair. The towel also has a plurality of loops formed in the edge of the peripheral hem which cooperate with elastic fastening bands that couple oppositely-disposed loops together so as to prevent lateral slippage of the towel relative to the mattress. Each end of a fastening band is provided with a pair of spaced-apart buttons which are selectively insertable into one of the loops to adjust the biasing force of the band to suit the type and size of the mattress covered. U.S. Pat. No. 4,273,380 discloses a beach accessory in the form of a combined beach towel, chair cover and tote bag which comprises an elongate strip of absorbent toweling having pockets on opposite major surfaces at one end. At least one of the pockets is large enough to store the entire length of the toweling not covered by the pockets. The pockets face inwardly of the toweling and have stringing-through cases along their free edges to allow closure to form the tote bag for said towel and other articles to be carried.

While the foregoing patents suggest improved chair covers, there nevertheless exists a need for a convenient and versatile cover design for use with beach-type lounge chairs which are adaptable to a variety of chair designs and which will fit snugly and also provide convenient pockets for storage of accessory and other personal items.

The present invention provides a novel and unique fitted covering that is particularly adapted for use with casual lounge chairs of the type commonly used at poolside or the beach. More particularly, in accordance with the present invention, a cover is provided having a panel of absorbent material substantially the size of the lounge chair with pockets formed at opposite ends which engage or fit over the ends of the pad or the lounge frame. An intermediate mediate elasticized section extends transversely of the cover to permit the cover to be fit over frames or pads of different size and to insure a snug fit. Longitudinally-extending elastic bands are provided adjacent the transverse elasticized strip to prevent the elasticized transverse strip from curling. Drop-type pockets are provided at opposite sides of the cover for containment of personal accessory items. Preferably, the pockets at one side of the cover are provided with closures formed from loop and hook fasteners of the type sold under the trademark Velcro. Pockets on the opposite sides of the cover are preferably open for containment of larger items. In a further embodiment, the material of the covering is an absorbent toweling or terry cloth material.

BRIEF DESCRIPTION OF THE DRAWINGS

The invention will be more fully understood from the following detailed description thereof taken in connection with the accompanying drawings in which:

FIG. 1 is a perspective view showing a lounge chair with the cover of the present invention applied thereto;

FIG. 2 is a sectional view taken along line 2—2 of FIG. 1;

FIG. 3 is a sectional view taken along line 3—3 of FIG. 1;

FIG. 4 is a sectional view taken along line 4—4 of FIG. 1;

FIG. 5 is a sectional view taken along line 5—5 of FIG. 1;

Figure 6:
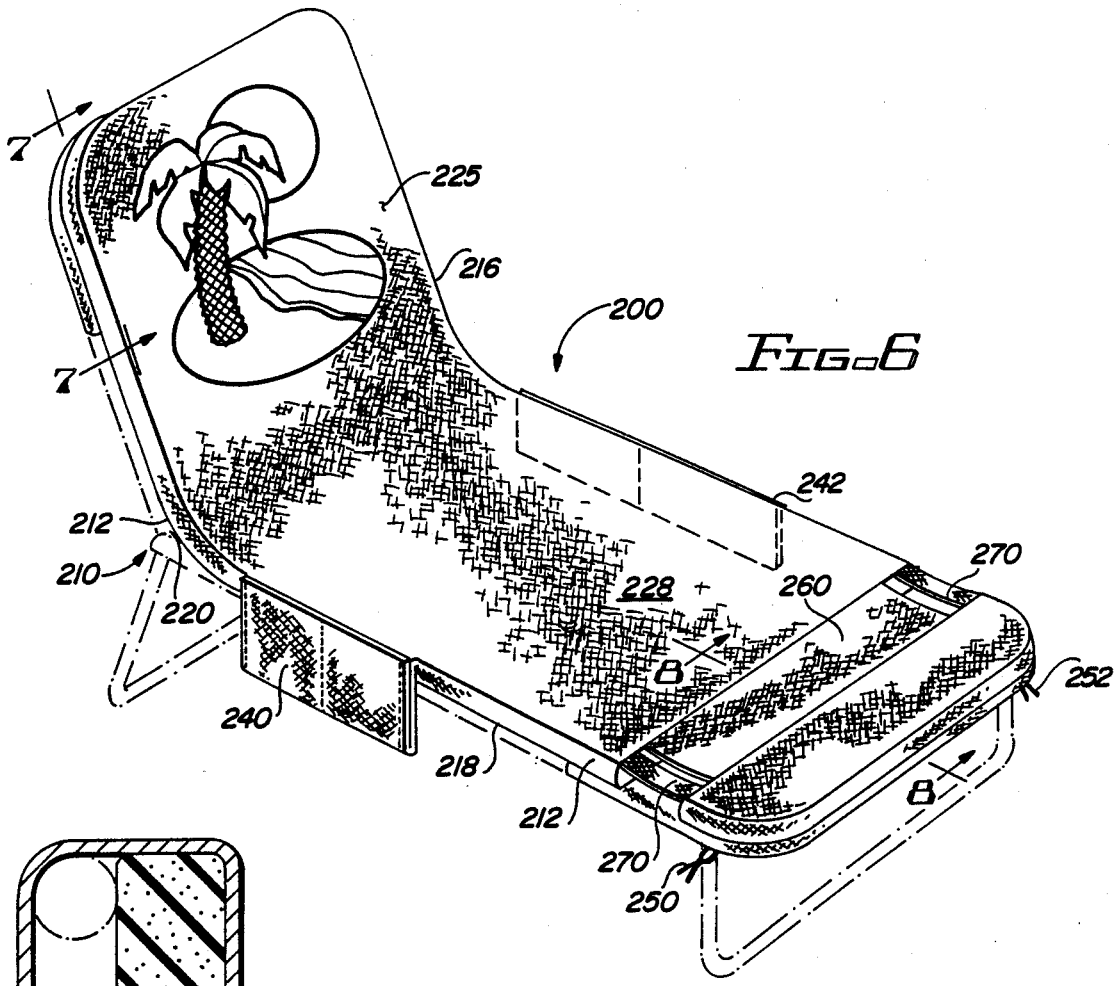
FIG. 6 is a perspective view showing a lounge chair with an alternate embodiment of the cover of the present invention apply and FIGS. 7 and 8 are sectional view taken along lines 7—7 and 8—8 of FIG. 6, respectively.

Referring now to the drawings, particularly FIGS. 1 to 5, a chaise lounge 10 is shown which for purposes of representation has a main section 12 with a back-supporting section 14 adjustably hinged thereto. The frame section 12 is supported on U-shaped transversely extending legs 16. The frame is fabricated from aluminum tubing or similar material. A covering extends over the frame and may be canvas or transversely extending plastic strips. A mattress or pad may be supported on the frame although the lounge 10 shown in FIG. 1 is of the type that normally does not include a mattress or pad.

The cover of the present invention is generally designated by the numeral 20 being fabricated from any suitable material, preferably a toweling material or absorbent terrycloth. The covering includes a top panel 25 which is generally rectilinear and as shown conforms generally in size to the upper portion 14 of the chaise frame which supports the user's back. Lower generally rectilinear covering portion 30 conforms generally in size and shape to the lower portion 12 of the frame. The upper covering section 25 has opposite parallel sides 26, 27, upper edge 29 and a lower transverse edge 28. The edges may be appropriately finished by a seaming sewing operation. Upper end pocket 35 is formed at the upper edge of panel 25 and extends transversely thereof being stitched to the upper edge 29 and including a transverse material strip 31 extending partway along opposite side edges 26 and 27 at the rear side of the frame section 14. The lower marginal edge 33 of trip 31 may be reverse folded and stitched to form a pocket 35 for containment of personal articles. Upper end pocket 35 snugly engages the upper end of chaise frame section 14.

Similarly, the lower panel 30 of the cover has opposite side edges 32, 34, a bottom edge 35 and a transverse verse upper edge 36. Again, the edges are appropriately finished by hemming operation. A pocket 40 is formed at the lower edge of the panel by a fabric strip 42 extending transversely of the panel member 30 and being secured to the panel by sewing operation along the lower edge 38 and extending partway along opposite side edges 32 and 34. Pocket 45 may also be formed as a reversely turned extension of the lower edge of panel section 20. The opposite sides of the pocket 45 are joined to side edges 32 and 34 so pocket 45 snugly engages the lower end of frame section 14.

Supplemental ties 51, 52 are provided at one corner of the cover and another pair of ties 53 and 54 are provided at the opposite lower corner of the cover. These ties may be used to further secure the cover against movement relative to the chaise lounge. The cover 20 can be placed over the upper and lower section of the frame of the chair and the ties used to secure the cover against movement Since chaise lounge chairs are of varying size, the construction of the present invention lends itself to adaptability for use with a wide range of sizes and designs such chairs. To this end, an intermediate elasticized section 60 extends transversely between edges 28 and 36 of the upper panel and the lower cover sections. The elasticized section is preferably a stretch terry cloth material having typically a width of six or seven inches. The elasticized material terminates at opposite edges 62 and 63 inward of the longitudinal or side edges of the panel members 25 and 30. The elasticized section preferably stretches in both the transverse and longitudinal direction to keep the cover section taut and snug on the lounge chair.

Longitudinally extending elasticized bands 70 and 71 are provided adjacent the opposite side edges of the elasticized section 60, the bands 70, 71 generally aligning with the opposite side edges of the panels 30 and 22. These bands stretch longitudinally and it has been found that the addition of these bands prevents the elasticized intermediate section 60 from undesirably curling and also contributes to the overall fit of the panels.

In order to accomodate the various personal accessory items which users often carry to the beach or poolside, pockets or receptacles are provided as an integral part of the cover. Attached along side edge 32 at a location disposed towards the upper edge 36 are drop pockets 80, 82 which are sewn to the side edge and preferably formed from the same or similar material as the cover. Pockets 80, 82 are shown in FIG. 3 and each is approximately six inches long having an opening 85 into the interior of the pocket. The opening 85 includes closure members 86 and 87 and are preferably in the form of loop and hook fastener material so the contents of the pocket can be secured. Preferably, the pockets are lined with a plastic lining 88 such as a vinyl sheet so that items such as lotions and suntan oils can be contained in the pockets without causing staining to the outer fabric material.

Another set of pockets 90, 92 are provided at the opposite side edge of the lower cover portion and are shown in FIG. 4. Pockets 90, 92 are preferably larger than the opposite pockets 80, 82 typically each being approximately twelve inches in length. The pockets are preferably of the same material as the panels 30 and 22 and are stitched to the longitudinal edge of panel 30. Pockets 90, 92 are designed signed for the reception of larger articles and are preferably open pockets which will hang or drape at the side of the cushion when the cover is positioned on the chaise lounge chair.

The cover of the present invention may be provided with various indicia 100 which may be silkscreened or appliqued to the fabric. The indicia may be decorative or may carry an advertising message, as for example, an advertisement for a particular resort or recreational product.

Figure 7:
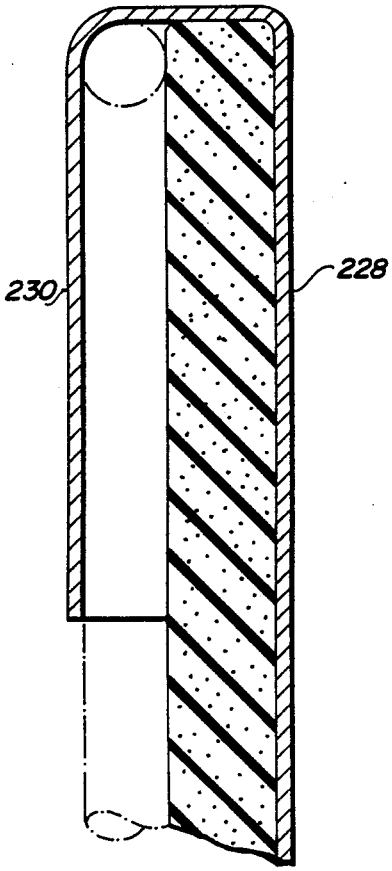
Figure 8:
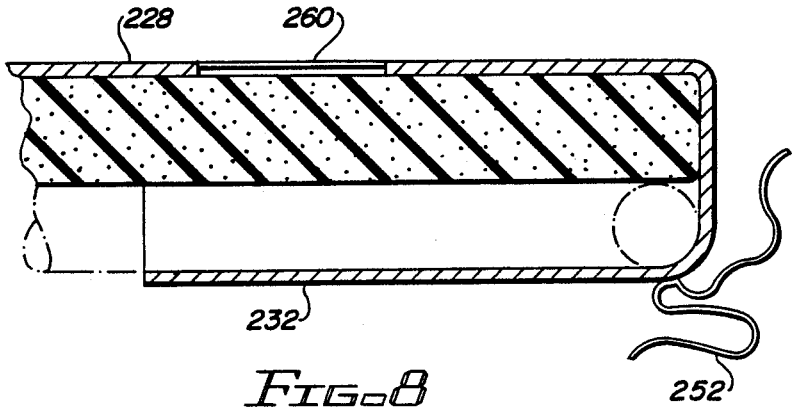

FIGS. 7 and 8 show a slightly modified version of the cover of the present invention generally designated the numeral 200. The cover 200 is shown applied to a chaise lounge 210 supporting a pad or mattress 212 having upper and lower sections 216 and 218 joined at transverse fold line 220.

The cover 225 is a suitable absorbent material such as terry cloth and has a main section 228 with a pocket 230 formed at the upper end to engage the upper end of the lounge and mattress. The lower end of section 228 is also provided with a pocket 232 that engages the foot end of the mattress and chaise lounge. Drop pockets 240 and 242 are provided at opposite sides of the covering. Auxilliary ties 250, 252 are also provided for additional securement.

A transverse elasticized panel or strip 260 is provided adjacent the lower end of the section 228 to provide a versatile and snug fit. Again, the elasticized strip terminates inwardly of the side edges of the cover and elastic bands 270 are provided extending between the cover section adjacent the edges of the elasticized strip to present curling. The bands 270 also contribute to the versatility and appearance of the cover.

While the cover has been shown and described in connection with several common beach or lounge chairs currently used, other types of lounge chairs may also be covered with the cover of the present invention. For example, the tri-fold type of chair having transverse plastic strips may also be covered with the towel for the convenience of the user. The towel will serve to insulate the user from the hot surface of the chair and will also absorb moisture from the user's body and suntan oils and the like. The towel also serves to protect the chair from moisture and oil and prevents staining of the cushioning material.

The towel may also be simply placed flat on the each for the user to recline on, pockets being convenient for carrying or storage of personal accessory items such as radios, books, suntan oils and the like.

It will be obvious to those skilled in the art to make various changes, alterations and modifications to the lounge chair cover of the present invention. To the extent such changes, alterations and modifications do not depart from the spirit and scope of the appended claims, they are intended to be encompassed therein.

I claim:

1. A fitted cover for a leg-supported lounge chair of the type having a body-supporting section with a head end, foot end and opposite side edges, said cover comprising:

(a) a cover panel having a top edge, a body edge, and opposite side edges, said cover generally conforming to the shape of the lounge chair body-supporting surface;

(b) a fitting pocket extending transversely of said cover panel at the top and bottom edges thereof and engageable with at least a part of the foot and head end of the chair to maintain the cover in position on said body-supporting section;

(c) an elasticized panel extending transversely of said cover panel at an intermediate location between said fitting pockets to apply tension to said cover panel to maintain the same snugly on said chair, said elasticized panel terminating inwardly of said panel side edges; and (d) elastic bands extending on said cover panel adjacent said elasticized panel at the side edges of said cover panel.

2. The fitted cover of claim 1 further including drop pocket at one of said side edges.

3. The fitted cover of claim 2 wherein said drop pocket is provided with closure means.

4. The fitted cover of claim 3 wherein said cover is lined with a moisture-resistant covering.

5. The fitted cover of claim 1 further including tie means associated with one of said top and bottom ends of said cover.

6. The fitted cover of claim 1 wherein the cover is fabricated from terry material.

7. The fitted cover of claim 1 further including indicia carried on said cover.

* * * * *